US006807925B1

(12) United States Patent
Lesage

(10) Patent No.: US 6,807,925 B1
(45) Date of Patent: Oct. 26, 2004

(54) EXPLOSION-PROOF HOT WATER HEATER WITH UNSEALED FUEL COMBUSTION CHAMBER

(75) Inventor: Claude Lesage, Pointe Claire (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 10/622,573

(22) Filed: Jul. 21, 2003

(30) Foreign Application Priority Data

Apr. 8, 2003 (CA) ..... 2424703

(51) Int. Cl.[7] ..... F24H 9/20

(52) U.S. Cl. ..... 122/14.1; 122/14.2; 122/14.21; 122/18.5; 122/19.2; 122/494; 122/504

(58) Field of Search ..... 122/13.01, 18.31, 122/18.5, 19.2, 494, 504

(56) References Cited

U.S. PATENT DOCUMENTS 5,020,512 A * 6/1991 Vago et al. ..... 122/18.2
5,091,715 A * 2/1992 Murphy ..... 340/604
5,836,554 A * 11/1998 Lesage ..... 248/152
6,230,665 B1 * 5/2001 Reynolds et al. ..... 122/13.01
6,412,447 B1 * 7/2002 Trant et al. ..... 122/14.21
6,497,200 B2 * 12/2002 Stretch et al. ..... 122/504
6,578,531 B1 * 6/2003 Cacace ..... 122/19.2
6,662,757 B2 * 12/2003 Lesage ..... 122/14.21
6,666,174 B1 * 12/2003 Lesage ..... 122/19.2

* cited by examiner

*Primary Examiner*—Jiping Lu
(74) *Attorney, Agent, or Firm*—Ogilvy Renault; Guy J. Houle

(57) ABSTRACT

An explosion-proof hot water heater of the type having a gas-fired combustion chamber at a lower end of the inner tank is described. The combustion chamber is an unsealed chamber and has a sealed bottom wall and a fuel burner in the combustion chamber. Combustion air intake ports are provided about the combustion chamber above the sealed bottom wall. A support base supports the sealed bottom wall elevated from a support surface. Air intake openings are provided about the outer skin casing of the hot water tank and spaced a predetermined distance above the sealed bottom wall. Air passages communicate the air intake openings with the combustion air intake ports of the combustion chamber. A gas vapour sensor is secured in relation to the support base below the sealed bottom wall and is adapted to cause the burner to be shut off upon detection of explosive vapours with sufficient time delay before such vapours reach the combustion chamber.

16 Claims, 5 Drawing Sheets

EXPLOSION-PROOF HOT WATER HEATER WITH UNSEALED FUEL COMBUSTION CHAMBER

TECHNICAL FIELD

The present invention relates to an explosion-proof hot water heater having an unsealed fuel combustion chamber and capable of detecting explosive vapours and shutting off the fuel burner with ample time delay before the explosive vapours can reach the combustion chamber.

BACKGROUND ART

Various attempts have been made in recent years to prevent the ignition of explosive vapours circulating about a hot water heater which is gas-fired, that is to say which is provided with a combustion chamber having a fuel burner therein. For example, it has been suggested to mount the hot water heater on an elevated support element, such as a rigid box or frame, and then to provide a gas sensor adjacent the floor area which is coupled to the gas shut off valve circuitry to shut the gas off upon detection of explosive vapours. Others have attempted to resolve this problem by providing a sealed combustion chamber with air combustion intakes being disposed elevated and communicating with the combustion chamber by ducts which are secured against the outer casing of the hot water heater. Usually this duct will extend several feet above the support floor. Again, gas sensors are provided to shut off the gas supply valve to the burner upon detection of explosive vapours. Screens have also been installed at air supply ports to act as flame arresters. These screens accumulate dust and clog up affecting adequate combustion air supply and therefore reducing the efficiency of the burner and emitting pollutant gas in the gas exhaust. These solutions have not proven feasible for the reason that some of these are costly, not practical in the real world, are subject to malfunction, affect the supply of sufficient combustion air to the combustion chamber, permit gas vapours to build up substantially before the burner is shut off and are generally not foolproof.

SUMMARY OF INVENTION

It is a feature of the present invention to provide an explosion-proof hot water heater with an unsealed fuel combustion chamber and capable of shutting off the gas supply to the burner at least a few minutes prior to the explosive gases reaching the air intake supply to the combustion chamber.

Another feature of the present invention is to provide an explosion-proof hot water heater of conventional type and having an unsealed fuel combustion chamber and wherein the novel feature of the hot water heater is simple in construction, economical, is integrated in the base construction of the heater housing, and easy to assemble.

According to the above features, from a broad aspect the, the present invention provides an explosion-proof hot water heater comprising an inner casing having conduit means to admit water in a water chamber thereof and to remove it therefrom. An outer skin casing is spaced from the inner casing with thermal insulation between the casings. The inner casing has a gas-fired combustion chamber at a lower end thereof. The combustion chamber has a sealed bottom wall and a circumferential side wall. A fuel burner is provided in the combustion chamber. Combustion air intake ports are provided in the circumferential side wall above the sealed bottom wall. A support base supports the sealed bottom wall elevated from a support surface. Air intake openings are provided about the outer skin casing spaced a predetermined distance above the sealed bottom wall. Air passage means communicates the air intake openings with the combustion air intake ports of the combustion chamber. A gas vapour sensor is secured in relation to the support base below the sealed bottom wall and is adapted to cause the burner to be shut off upon detection of explosive vapours.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
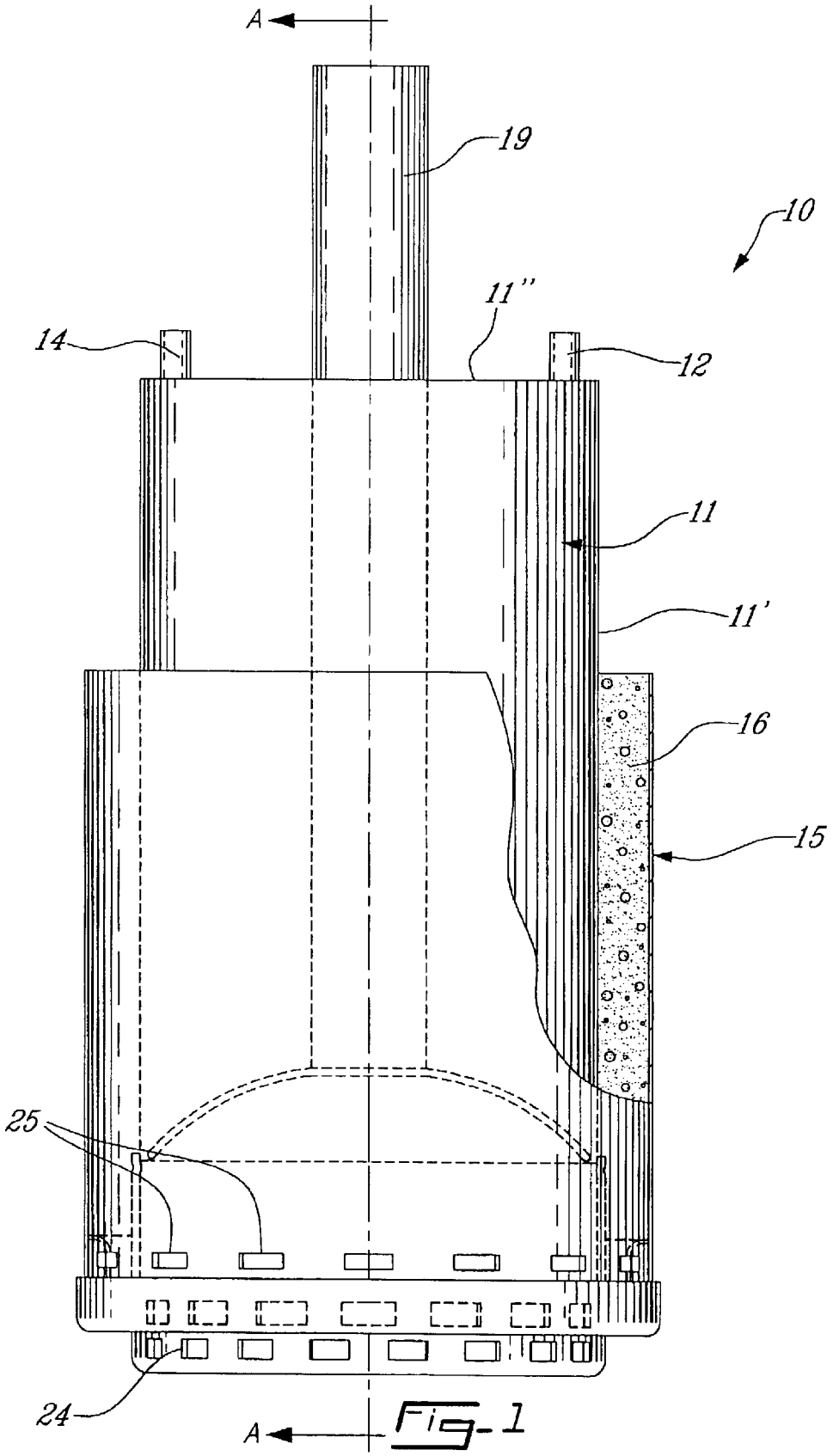
FIG. 1 is a partly fragmented side view of an explosion-proof hot water heater constructed in accordance with the present invention.
Figure 2:
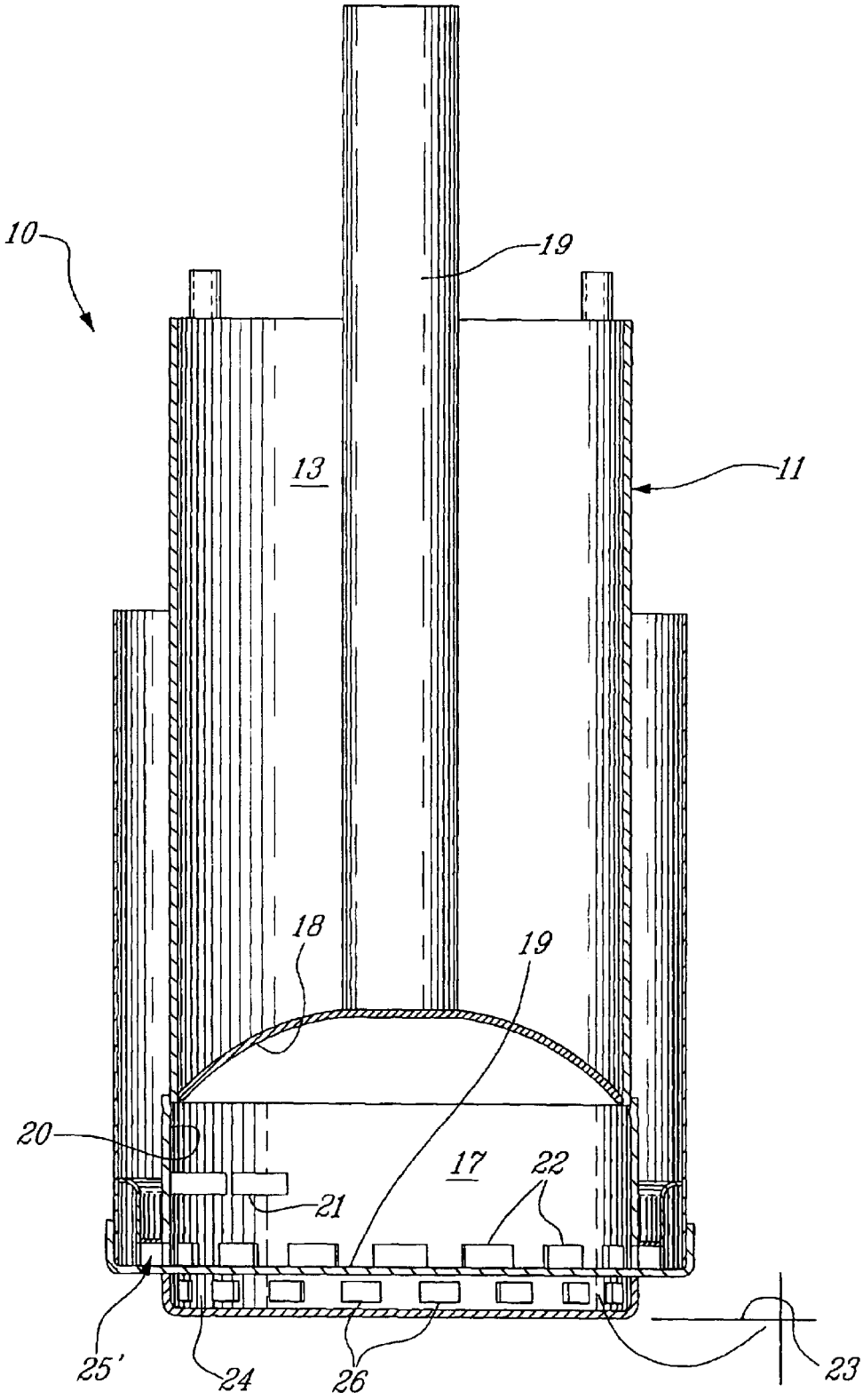
FIG. 2 is a section view along section line A—A of FIG. 1.

Referring to the drawings, and more particularly to FIGS. 1 and 2, there is shown generally at 10 an explosion-proof hot water heater constructed in accordance with the present invention. It includes essentially an inner casing 11 which is a steel casing provided with an inlet conduit 12 to admit water to be heated in a water chamber 13 of the inner casing, and an outlet conduit 14 to supply hot water heater for consumer use. An outer skin casing 15, which is usually constructed of a thin metal sheet, extends in spaced relationship about the side wall 11' and top wall 11" of the inner casing, although herein only a lower cut-out section of the outer skin casing is illustrated. An insulating foam material 16, such as "Greenfoam", registered trade mark of Giant Factories, Inc., is injected between the outer surface of the inner casing 11 and inner surface of the outer skin casing 15 whereby to provide thermal insulation about the inner casing.

As shown in FIG. 2, the inner casing 11 is supported over a gas-fired combustion chamber 17 at a lower end thereof. The top wall of the combustion chamber 17 is constituted by the concave bottom wall 18 of the inner casing. A central flue pipe 19 extends through the inner casing and out of the hot water heater 10 to connect to exhaust pipes to release products of combustion outside a building in which the hot water heater is located. The products of combustion are exhausted by natural draft or are power vented, as well known in the art.

The combustion chamber 17 has a sealed bottom steel wall 19 and a circumferential side wall 20. The side wall 20 is hereinshown welded concentrically over the bottom wall. A fuel burner 21 is mounted in the combustion chamber 17.

Combustion air intake ports 22 are provided in the circumferential wall 20 and disposed above the sealed bottom wall 19. The sealed bottom wall 19 is provided with a support base 24 to support the bottom wall 19 elevated above a floor surface 23.

As shown in FIG. 1, air intake openings 25 are formed and distributed about a lower end portion of the outer skin casing 15, all about the casing whereby to supply combustion air to the combustion chamber 17. These air intake openings 25 are spaced a predetermined distance above the sealed bottom wall 19 and the floor surface 23. As shown in FIG. 2, air passage means, generally identified by arrow 25', communicates the air intake openings 25 with the combustion air intake ports 22 of the combustion chamber 17. A gas vapour sensing means, as will be described later, is secured in relation to the support base 24 below the sealed bottom wall and is adapted to cause the burner 21 to be shut off upon detection of explosion vapours, as will be described later. The gas vapour sensing means can be mounted inside the hollow support base 24 or on the outside wall thereof. As hereinshown, the support base is provided with ventilating apertures 26 to provide air flow under the sealed bottom wall whereby to cool the support base adjacent the floor surface 23. The support base 24 may also have an insulating rigid foam disc therein to insulate the combustion chamber.

Figure 3:
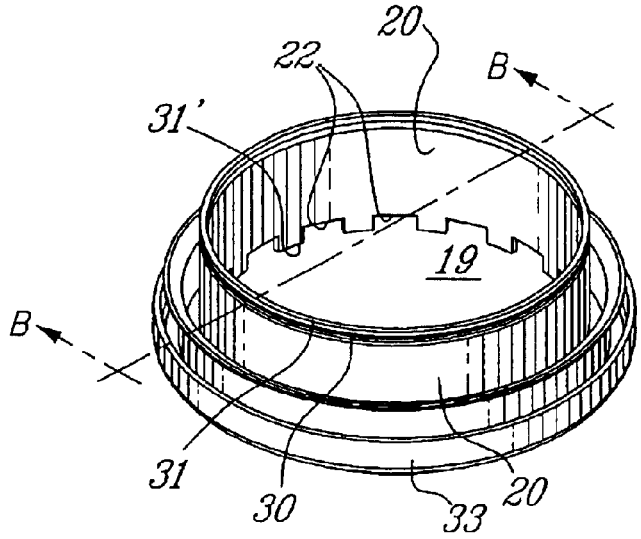
FIG. 3 is a perspective view showing the construction of the bottom pan and the circumferential side wall of the combustion chambers supported and secured thereon.
Figure 4:
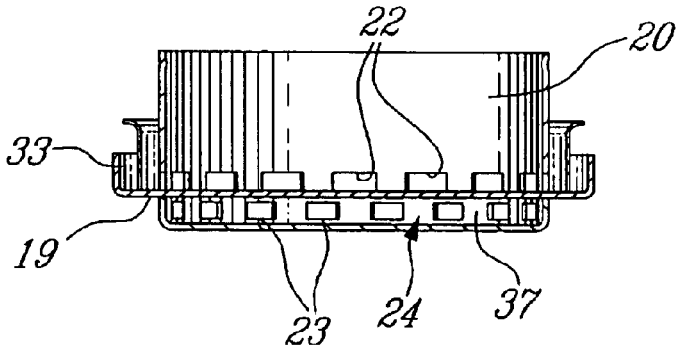
FIG. 4 is a section view taken along cross-section line B—B of FIG. 3.
Figure 5:
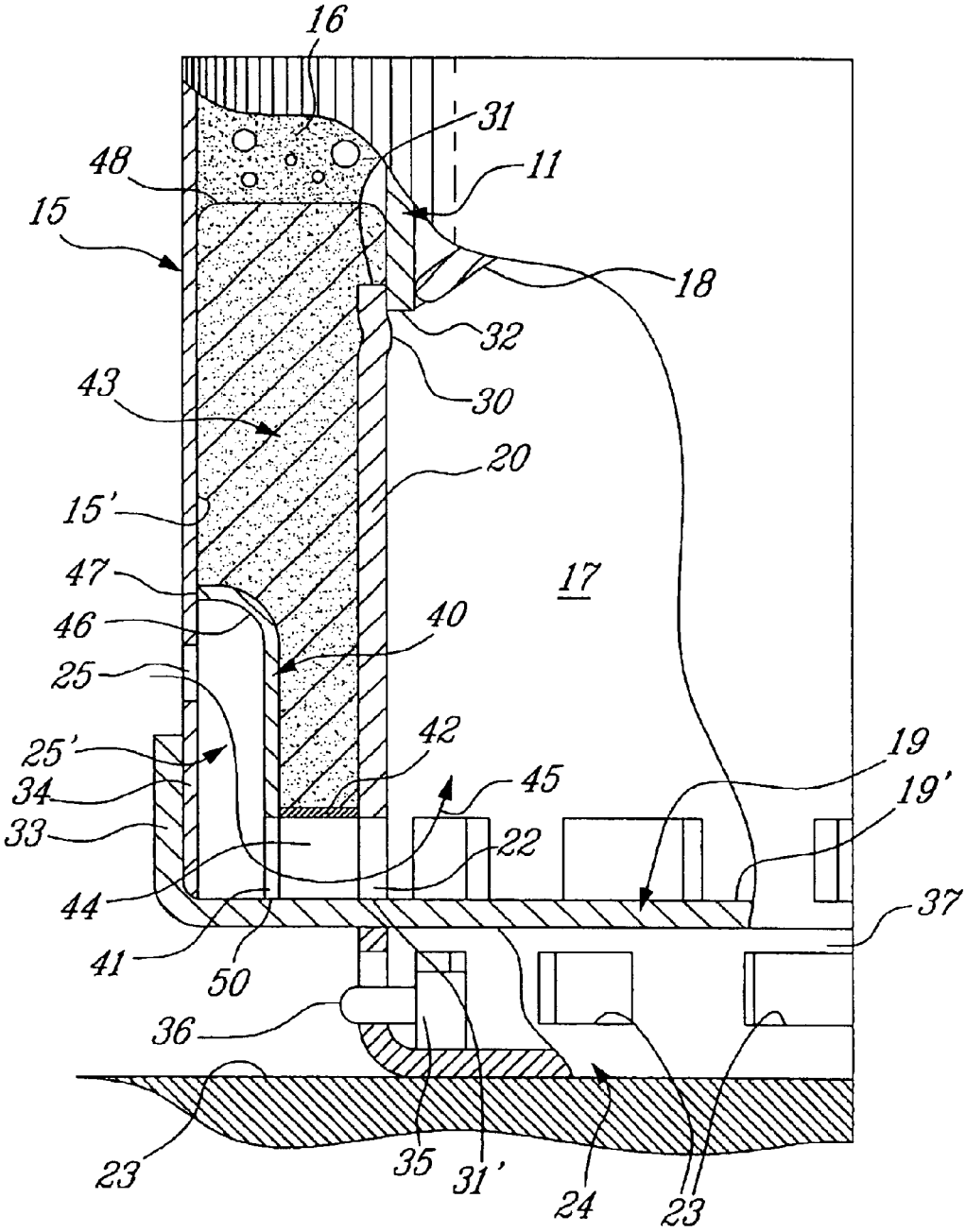
FIG. 5 is an enlarged fragmented section view showing the component parts of the explosion-proof hot water heater constituting the inventive portion thereof.

With reference now to FIGS. 3 to 5, there will be described the manner in which the lower portion of the hot water heater 10 is constructed to achieve the objects of the present invention. As hereinshown, the combustion chamber circumferential side wall 20 is a circular cylindrical steel wall which is centrally secured on the sealed bottom wall 19 which is also a steel wall of circular outline and which extends concentrically outwards of the combustion chamber cylindrical side wall 20. As shown more clearly in FIG. 5, the circumferential side wall 20 is formed with a cylindrical bead 30 extending inwardly adjacent a top edge 31 of the side wall 20 and is dimensioned to supportingly receive a bottom circumferential edge 32 of the inner casing 11 thereon and in close fit with a top portion of the circumferential side wall 20. The sealed bottom wall constitutes a pan bottom wall and is provided with an upwardly extending circumferential flange 33 which is dimensioned to receive a bottom portion 34 of the outer skin casing 15 in close fit therebehind to be supported on the sealed bottom wall 19.

As better illustrated in FIGS. 3 to 5, the combustion air intake ports are provided by rectangular slots formed about the bottom edge 31' of the circumferential side wall 20 and have equidistantly spaced rectangular openings constituting the air intake ports 22. As shown in FIG. 5, the combustion air intake openings 25, formed about the outer skin casing 15, are disposed elevated above the combustion air intake ports 22. In the design herein illustrated in FIG. 5, the support base 24 has a height of approximately 1 inch and the air intake openings 25 are disposed at least 2 inches above the support base. The gas vapour sensor 35 is hereinshown mounted in the support base 24 and its sensing element 36 is disposed as close as possible to the floor surface 23 and preferably within ½ an inch from that floor surface. Because the support base is provided with apertures 26, the sensor 35 may not be visible from the outside of the hot water heater as air circulates within the support base and vapours can be detected. inside the base. These apertures 26 are provided all about the circumferential side wall 37 of the base 24. The distance between the gas sensor 35 and the air intake openings 25 is approximately 3 inches and in experimental testing it has been shown that this distance provides an approximate time delay of 2 minutes before explosive vapours can rise to the air intake openings 25 after having been detected. These vapours are heavier than air and thereby rise slowly.

Figure 6:
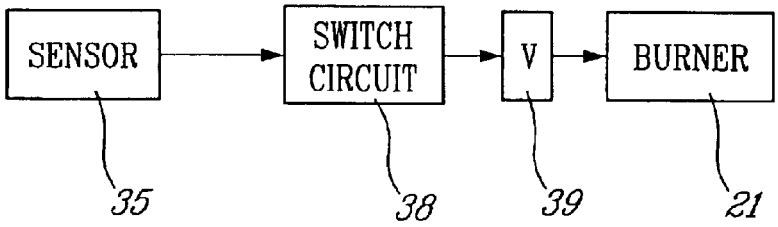
FIG. 6 is block diagram of the gas valve supply switching circuit actuated by the explosive vapour sensor.

As shown in FIG. 6, the sensor 35, upon detection of explosive vapours provides a signal to a switch actuating circuit 38 which operates the gas supply valve 39 whereby to shut off gas supply to the burner 21. This arrangement is well known in the art.

Referring again to FIG. 5, there will be described in more detail the gas passage means 25' interconnecting the intake air openings 25 to the combustion air intake ports 22. As hereinshown and also illustrated in FIGS. 3 and 4, a circumferential air deflecting wall 40 is spaced inwardly of the outer skin casing 15 adjacent the air intake openings 25 for directing air which is aspired as fired by the hot burner 21 and the hot combustion chamber, downwardly towards the sealed bottom wall and then through further openings 41 provided spaced-apart along a bottom edge of the deflecting wall 40 and then under a spacer flange 42 punched from the circumferential air deflecting wall 40 and abutting the circumferential side wall 20 of the combustion chamber. These openings 41 are aligned with the combustion air intake ports 22.

Figure 7:
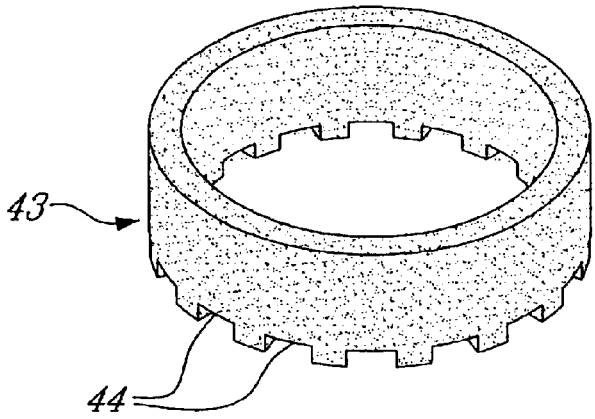
FIG. 7 is a perspective view of the fiberglass insulating jacket.

As shown in FIG. 7, a thermal insulating, fire-proof fiberglass jacket 43 is also provided with slots 44 which are slightly longer than the slot openings 41 in the circumferential air deflecting wall 40 and those of the combustion air intake ports 22 and is disposed between the combustion chamber circumferential side wall 20 and the inner surface of the outer skin casing 15. The slots 44 in the fiberglass mat are dimensioned such as to sit on the spacer flange 42 whereby these slots 44 automatically align with the openings 44 and air intake ports 22. Accordingly, air flows from the openings 25 to the ports 44 as indicated by arrow 45 and the thermal insulating jacket does not affect air flow.

In order to facilitate air flow in the air passage 25', the top portion of the air deflecting wall 40 is curved and as hereinshown, has a concave curvature 46. The outer circumferential edge 47 of the air deflecting wall 40 is dimensioned to abut against the inner surface 15' of the outer skin casing 15. As hereinshown, the fiberglass insulation 43 extends above the bottom wall 18 of the inner casing to encircle the combustion chamber 17. The foam insulation 16 is injected between the casing and the top wall 48 of the fiberglass insulating jacket 43. This foam insulation 16 is injected in a poly apron, not shown, disposed about the inner casing side wall.

As shown in FIGS. 4 and 5, the lower circumferential edge 50 of the air deflecting wall rests on the top surface 19' of the sealed bottom wall 19. The spacer flange 42 constitutes a circumferential spacing means between the air deflecting wall and the side wall of the combustion chamber and the curved upper portion constitutes a spacing means between the air deflecting wall and the outer skin casing 15. Thus, the air deflecting wall 40 is self positioning.

It is within the ambit of the present invention to cover any obvious modifications of the preferred embodiment described herein, provides such modifications fall within the scope of the appended claims.

I claim:

1. An explosion-proof hot water heater comprising an inner casing having conduit means to admit water in a water chamber thereof and to remove it therefrom, an outer skin casing spaced from said inner casing with thermal insulation between said casings, said inner casing being supported over a gas-fired combustion chamber at a lower end thereof, said combustion chamber having a sealed bottom wall and a circumferential side wall, a fuel burner in said combustion chamber, combustion air intake ports in said circumferential side wall above said sealed bottom wall, a support base for supporting said sealed bottom wall elevated from a support surface, air intake openings about said outer skin casing spaced a predetermined distance above said sealed bottom wall, air passage means communicating said air intake openings with said combustion air intake ports of said combustion chamber, and a gas vapour sensor secured in relation to said support base below said sealed bottom wall and adapted to cause said burner to be shut off upon detection of explosive vapours, said support base having a circumferential side wall, said gas vapour sensor being secured inside said support base and having a gas sensing element secured to said circumferential side wall to detect the presence of explosive vapours adjacent said support surface.

2. An explosion-proof hot water heater as claimed in claim 1 wherein said combustion air intake openings are disposed spaced above said combustion air intake ports of said combustion chamber.

3. An explosion-proof hot water heater as claimed in claim 2 wherein said support base has a height of approximately one inch, said air intake openings being disposed at least two inches above said support base.

4. An explosion-proof hot water heater as claimed in claim 2 wherein said air passage means comprises a circumferential air deflecting wall spaced inwardly of said outer skin casing adjacent said air intake openings for directing air aspired by said burner downwardly towards said sealed bottom wall and then through passage means disposed spaced adjacent said combustion air intake ports.

5. An explosion-proof hot water heater as claimed in claim 4 wherein said air deflecting wall has a curved top portion defining an outer circumferential outer edge dimensioned to abut against an inner surface of a bottom portion of said outer skin casing.

6. An explosion-proof hot water heater as claimed in claim 5 wherein said air deflecting wall has a straight bottom portion defining a lower circumferential edge adapted to rest on said sealed bottom wall, and openings disposed about said straight bottom portion adjacent said lower circumferential edge and consisting said passage means.

7. An explosion-proof hot water heater as claimed in claim 6 wherein a circumferential spacing means is secured to said straight bottom portion and disposed above said openings and extends between said straight bottom portion and said circumferential side wall of said combustion chamber, and a fireproof thermal insulation jacket, said air deflecting wall and said side wall of said combustion chamber, said insulation jacket having air passages aligned with said openings of said straight bottom portion of said air deflecting wall.

8. An explosion-proof hot water heater as claimed in claim 1 wherein said support base is provided with venting apertures thereabout to cool said sealed bottom wall.

9. An explosion-proof hot water heater as claimed in claim 1 wherein the distance between said gas sensing element and said air intake openings provides an approximate time delay of two minutes for said explosive vapour to rise to said intake openings.

10. An explosion-proof hot water heater as claimed in claim 1 wherein said circumferential side wall of said combustion chamber is constituted by a steel cylinder centrally secured on said sealed bottom wall, said cylinder having a cylindrical bead extending inwardly adjacent a top edge of said cylinder and dimensioned to supportingly receive a bottom circumferential edge of said inner casing thereon and in close fit with a top portion of said cylinder.

11. An explosion-proof hot water heater as claimed in claim 10 wherein said sealed bottom wall is constituted by a pan bottom wall, said pan bottom wall having a circumferential flange extending upwardly, said pan being dimensioned to receive a bottom portion of said outer skin casing in close-fit therebehind to be supported on said sealed bottom wall.

12. An explosion-proof hot water heater as claimed in claim 10 wherein said combustion chamber has a concave bottom wall and a central flue pipe extending from said concave bottom wall through said water chamber and out of said hot water heater to connect to a chimney to exhaust combustion fumes.

13. An explosion-proof hot water heater as claimed in claim 1 herein said gas vapour sensor is connected to a switching circuit which operates a gas supply valve to shut off gas supply to said fuel burner to extinguish same.

14. An explosion-proof hot water heater comprising an inner casing having conduit means to admit water in a water chamber thereof and to remove it therefrom, an outer skin casing spaced from said inner casing with thermal insulation between said casings, said inner casing being supported over a gas-fired combustion chamber at a lower end thereof, said combustion chamber having a sealed bottom wall and a circumferential side wall, a fuel burner in said combustion chamber, combustion air intake ports in said circumferential side wall above said sealed bottom wall, a support base for supporting said sealed bottom wall elevated from a support surface, air intake openings about said outer skin casing spaced a predetermined distance above said sealed bottom wall, air passage means communicating said air intake openings with said combustion air intake ports of said combustion chamber, and a gas vapour sensor secured in relation to said support base below said sealed bottom wall and adapted to cause said burner to be shut off upon detection of explosive vapours, said combustion air intake openings being disposed spaced above said combustion air intake ports of said combustion chamber, said air passage means being comprised of circumferential air deflecting wall spaced inwardly of said outer skin casing adjacent said air intake openings for directing air aspired by said burner downwardly towards said sealed bottom wall and then through passage means disposed spaced adjacent said combustion air intake ports, said air deflecting wall having a curved top portion defining an outer circumferential outer edge dimensioned to abut against an inner surface of a bottom portion of said outer skin casing.

15. An explosion-proof hot water heater as claimed in claim 14 wherein said air deflecting wall has a straight bottom portion defining a lower circumferential edge adapted to rest on said sealed bottom wall, and openings disposed about said straight bottom portion adjacent said lower circumferential edge and consisting said passage means.

16. An explosion-proof hot water heater as claimed in claim 15 wherein a circumferential spacing means is secured to said straight bottom portion and disposed above said openings and extends between said straight bottom portion and said circumferential side wall of said combustion chamber, and a fireproof thermal insulation jacket, said air deflecting wall and said side wall of said combustion chamber, said insulation jacket having air passages aligned with said openings of said straight bottom portion of said air deflecting wall.

* * * * *